US009155344B1

(12) United States Patent
Romm

(10) Patent No.: US 9,155,344 B1
(45) Date of Patent: Oct. 13, 2015

(54) MULTIPLE LAYER HAIR ENHANCEMENT, ADDITION, OR EXTENSION

(71) Applicant: Sherri Romm, Owings Mills, MD (US)

(72) Inventor: Sherri Romm, Owings Mills, MD (US)

( * ) Notice: Subject to any disclaimer, the term of this patent is extended or adjusted under 35 U.S.C. 154(b) by 0 days.

(21) Appl. No.: 14/089,359

(22) Filed: Nov. 25, 2013

(51) Int. Cl.
*A41G 5/00* (2006.01)

(52) U.S. Cl.
CPC ..... *A41G 5/004* (2013.01)

(58) Field of Classification Search
CPC ..... A41G 3/00; A41G 3/0008; A41G 3/0033; A41G 3/0041; A41G 3/005; A41G 3/0066; A41G 5/004
USPC ..... 132/201, 53–56
See application file for complete search history.

(56) References Cited

U.S. PATENT DOCUMENTS

| | | | | |
|---|---|---|---|---|
| 7,320,327 | B2 | 1/2008 | Frazier | |
| 7,735,495 | B2 * | 6/2010 | Lane et al. | 132/53 |
| 7,909,041 | B2 * | 3/2011 | Yoneda et al. | 132/53 |
| 2006/0086368 | A1 * | 4/2006 | Salinas | 132/201 |
| 2009/0126753 | A1 * | 5/2009 | Sugai et al. | 132/201 |
| 2009/0235943 | A1 * | 9/2009 | Sugai et al. | 132/54 |
| 2011/0168196 | A1 | 7/2011 | Freelove | |
| 2013/0098380 | A1 | 4/2013 | Kim | |
| 2013/0133680 | A1 * | 5/2013 | Wang | 132/201 |
| 2013/0167855 | A1 | 7/2013 | Kupitz | |

* cited by examiner

*Primary Examiner* — Rachel Steitz

(74) *Attorney, Agent, or Firm* — Ditthavong & Steiner, P.C.

(57) ABSTRACT

Hair enhancements, additions, and extensions that are, realistic, seamless, comfortable, secure, durable, and hygienic are disclosed. Embodiments include a hair product including a first layer, a second layer having an open weave structure, a third layer, the first and third layers encasing the second layer, and a plurality of strands of hair, each of the plurality of strands of hair being affixed to the second layer and extending therefrom. Other embodiments include a hair piece including a base comprising first, second, and third layers, the first and third layers at least partially encasing the second layer, and a plurality of strands of hair extending from the second layer.

18 Claims, 7 Drawing Sheets

100

100

100

MULTIPLE LAYER HAIR ENHANCEMENT, ADDITION, OR EXTENSION

TECHNICAL FIELD

The present disclosure relates to a hair enhancement, addition, extension, and the like. The present disclosure is particularly applicable to hair pieces worn on the head (e.g., wig, toupee, etc.), and more particularly to hair pieces worn on top of a user's own (e.g., natural) hair.

BACKGROUND

The art of making hairpieces and wigs has been practiced for many years; however, these hairpieces may be designed for permanent, advanced male and female pattern baldness. Very little may have been designed to address site specific hair thinning and loss due to a myriad of both medical and non-medical factors. In addition, hairstyle versatility and effects (such bangs, wigs, volumizers, extensions, ponytails, etc) and reduced maintenance are in high global demand. Hairpieces and wigs on the market may offer fair to poor results for natural appearance, customization, integration with user's own hair, and simplicity of application by the user.

Hairpieces and wigs known in the art may lack a natural appearance, are prohibitively expensive, bulky, uncomfortable, hot, bumpy, ill-fitting, invasive, and may retard a user's own hair growth. Further, such hairpieces may: (1) be too heavy (too much hair) to disguise conventional bases; (2) limit or ignore the natural growth pattern of hair; (3) be synthetic or utilize poor quality human hair which does not mimic the qualities of real growing hair; (4) be unnatural in appearance; (5) be easily detectable; (6) fail to seamlessly integrate into a user's own hair; and (7) have poor or unrealistic front hairlines.

A need therefore exists for an improved hair piece, particularly, for hair enhancement, addition, or extension.

SUMMARY

An aspect of the present disclosure is a hair piece including, inter alia, a top layer, such as silk, e.g., fine nude color silk, a center layer, such as an open lace layer, e.g. of Swiss lace, and a bottom layer, such as silk, e.g., of fine pure organic silk.

Additional aspects and other features of the present disclosure will be set forth in the description which follows and in part will be apparent to those having ordinary skill in the art upon examination of the following or may be learned from the practice of the present disclosure. The advantages of the present disclosure may be realized and obtained as particularly pointed out in the appended claims.

According to the present disclosure, some technical effects may be achieved in part by a hair piece including: a first layer (e.g., fine nude color silk); a second layer (e.g., fine nude color open weave Swiss lace), the second layer having a folded perimeter; a third layer (e.g., fine nude color silk), the first and third layers, at least partially, encasing the second layer; an encasement layer (e.g., binding), such as a lightly coated silk ribbon surrounding edges of the first and third layers and extending therefrom, such as a distance of about ⅛ of an inch (3.175 millimeters) over outer surfaces of the first and third layers; a plurality of strands of hair, each of the plurality of strands of hair being affixed (e.g., by a double knot) to the second layer and having long and return ends protruding though the first layer; and (four) comb clips, e.g., having a medium nude color, each being affixed to an underside of the third layer.

Aspects include a hair piece, wherein the first, second, and third layers have one of the following shapes: a rectangular front portion having rounded corners and a round back portion; an oval; a rectangular front portion having rounded corners and a rectangular back portion having rounded corners; a circle; and a rectangular front portion having rounded corners and a hexagon back portion having rounded corners.

Additional aspects and technical effects of the present disclosure will become readily apparent to those skilled in the art from the following detailed description wherein embodiments of the present disclosure are described simply by way of illustration of the best mode contemplated to carry out the present disclosure. As will be realized, the present disclosure is capable of other and different embodiments, and its several details are capable of modifications in various obvious respects, all without departing from the present disclosure. Accordingly, the drawings and description are to be regarded as illustrative in nature, and not as restrictive.

BRIEF DESCRIPTION OF THE DRAWINGS

The present disclosure is illustrated by way of example, and not by way of limitation, in the figures of the accompanying drawing and in which like reference numerals refer to similar elements and in which.

DETAILED DESCRIPTION

Figure 1B:
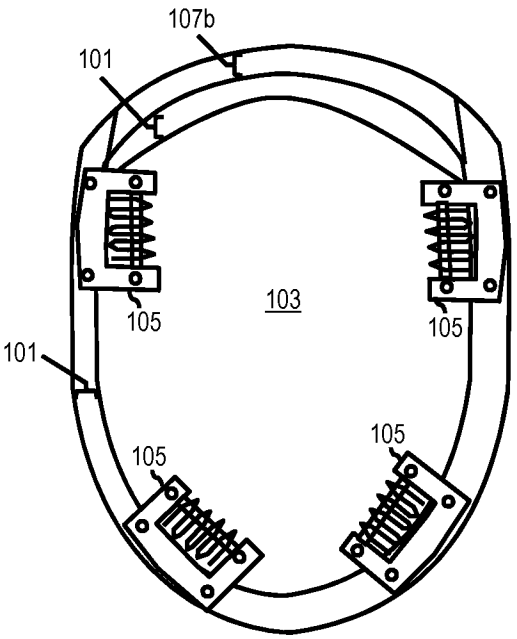
FIGS. 1A and 1B illustrate an underside/bottom view of hair pieces, in accordance with exemplary embodiments.

In the following description, for the purposes of explanation, numerous specific details are set forth in order to provide a thorough understanding of exemplary embodiments. It should be apparent, however, that exemplary embodiments may be practiced without these specific details or with an equivalent arrangement. In other instances, well-known structures and devices are shown in block diagram form in order to avoid unnecessarily obscuring exemplary embodiments. In addition, unless otherwise indicated, all numbers expressing quantities, ratios, and numerical properties of ingredients, reaction conditions, and so forth used in the specification and claims are to be understood as being modified in all instances by the term "about."

As used herein, hair piece includes hair products for hair enhancement, addition, extension, and the like. As such, hair pieces may be used in various medical and non-medical applications. By way of example, medical applications include men, women, children, with light, moderate, or advanced hair loss that is temporary or permanent. Such hair loss may include, for example, female pattern hair loss, male pattern hair loss, medications, early menopause (e.g., caused by cancer treatments), post pregnancy hair shedding, trichotillomania (e.g., hair pulling), alopecia areata, radiation, surgery causing temporary or permanent hair loss, cancerous moles, brain tumors, aneurysm, post hair transplantation, facelifts, injury to scalp, trauma or deformities, chemical burns, bad plugs and scars, traction alopecia, thyroid disease, telogen effluvium, dermatological (e.g., skin/scalp) diseases or conditions, protect from sun damage and environmental damage to scalp, and the like. Non-medical applications may include, for instance, cosmetic reasons to incorporate more hair. For example, to alter natural hair by modifying a volume, lift, fullness, length, color (e.g., color enhancement), (increase) styling versatility, and the like. Additionally, non-medical applications may include reducing styling 'prep' time, looking younger and more radiant, reducing a maintenance and cost associated with natural hair, raising self esteem, and socialability, and the like. Furthermore, many hair pieces are used for special occasions, such as weddings, proms, etc. It is contemplated that hair pieces may be utilized in various other applications, for instance, on animals (e.g., horses, dogs, etc.) or in fashion accessories.

As previously discussed, traditional hairpieces and wigs may lack a natural appearance, may be prohibitively expensive, bulky, uncomfortable, hot, bumpy, ill-fitting, invasive, and may retard a user's own hair growth. Further, such hairpieces may: (1) be too heavy (too much hair) to disguise conventional bases; (2) limit or ignore the natural growth pattern of hair; (3) be synthetic or utilize poor quality human hair which does not mimic the qualities of real growing hair; (4) be unnatural in appearance; (5) be easily detectable; (6) not integrate seamlessly into user's own hair; and (7) have poor or unrealistic front hairlines. Traditional methods of hair attachment may include bonding, taping, clipping, and weaving.

Bonding is generally for advanced and permanent thinning or balding. Users frequently have an entire area of "reconstruction" (e.g., area hair is to be added) to be shaved down completely or a 1" (2.54 centimeters) track shaved down on a user's own hair with hair being approximately ⅛" (3.2 millimeters) in length. Then either a silicone or cyclocyanoacrylate (e.g., superglue) based adhesive is commonly used to secure the hairpiece to the user's head. A hairpieces secured in such a manner usually stays on a user's scalp or hair up to about four weeks and sometimes less for users with an oily scalp or for very active users. User's frequently come back to a salon or hair replacement center to take off and reattach such a hairpiece as it either "grows off" or comes undone from the user's scalp. Dermatologically speaking, bacteria may easily grow and dermatitis can develop under unsanitary or overexposed conditions. In addition, over time the hair that has been shaved and subject to bonding adhesives can permanently damage hair follicles. Many users do not endorse this method as it forfeits natural growing hair that is shaved down. Additionally, bonding is frequently expensive in both budget and time. For instance, some bonding methods use between 4-6 hairpieces per year and users commonly return to a salon or hair replacement center monthly to have service performed. Frequently a user's vacations, traveling, and busy schedules cause potential scheduling challenges that can be exacerbated by high turnover in salons causing inconsistency and unpredictable results.

Taping is similar to bonding, in that it is generally used for advanced and permanent thinning or balding. Typically, any place where tape is used to secure a hairpiece is shaved. While commonly more hygienic than bonding adhesive, a user commonly takes off the hair piece either every day or every few days and reattach the hair piece themselves. Some users do not like this option as it requires shaving their hair down and accurately placing and securing hair piece down themselves. Similar to bonding, because taping forfeits natural growing hair that is shaved down, many users do not endorse this method. For instance, many users do not want to look at themselves without hair nor want their spouses knowing their hair issues.

Clipping is generally cleaner and more hygienic than bonding and taping, but frequently requires user intervention on a daily basis. Additionally, users commonly have a short learning curve to develop dexterity for securing and placing a hairpiece properly on their head. Clipping attachments may provide user independence and protect integrity of a user's own head unless the hairpiece is improperly designed, too heavy, or improperly handled by the user. Traditional hair pieces that are clipped on are frequently heavy, one size fits all, have too much hair and coverage, or are complicated in their integration of existing hair. In addition, many of such hair piece do not appear natural and are covered, resulting in a look that is unnatural (e.g., no scalp shown), a forced hair direction, an inability to style freely, and a heavy hair piece.

Weaving generally involves hair wefts or small bundles of hair woven, braided, glued or sewn onto natural hair to add bilk or nodules. However, weaving frequently complicates hair care protocol and may result in excessive stress on natural hair that it's bonded. For instance, extensions, weaves, and the like hanging on hair frequently causes damage over time and may not rebound. Frequently, weight from extensions pulls on a person's natural hair over time, causing it to rip out natural hair by the root. Furthermore, natural hair follicles can be damaged or destroyed using weaving, in some cases, permanently. Additionally, weaving may also require constant maintenance and dependency on a hair weaver.

As illustrated above, many users, particularly users with temporary or permanent hair loss, could benefit from a hair piece that (1) omits unnecessarily shaving natural hair; (2) uses no harmful adhesives or injuring attachments; (3) has a low cost on time, money, and emotional energy; and (4) does not create a financial, lifelong, or dependent situation where a user is dependent on hair replacement companies and technicians.

As such, there is a need for a hair enhancement/addition/extension that is, realistic, seamless, comfortable, secure, durable, hygienic, provides coverage or volume (not in excess), and protects the integrity of a users own natural hair.

The present disclosure addresses and solves such problems. In accordance with embodiments of the present disclosure, the problems are solved, for instance by, inter alia, encapsulating a lace layer with a top and bottom layer.

Still other aspects, features, and technical effects will be readily apparent to those skilled in this art from the following detailed description, wherein preferred embodiments are shown and described, simply by way of illustration of the best mode contemplated. The disclosure is capable of other and different embodiments, and its several details are capable of modifications in various obvious respects. Accordingly, the drawings and description are to be regarded as illustrative in nature, and not as restrictive.

Figure 1A:
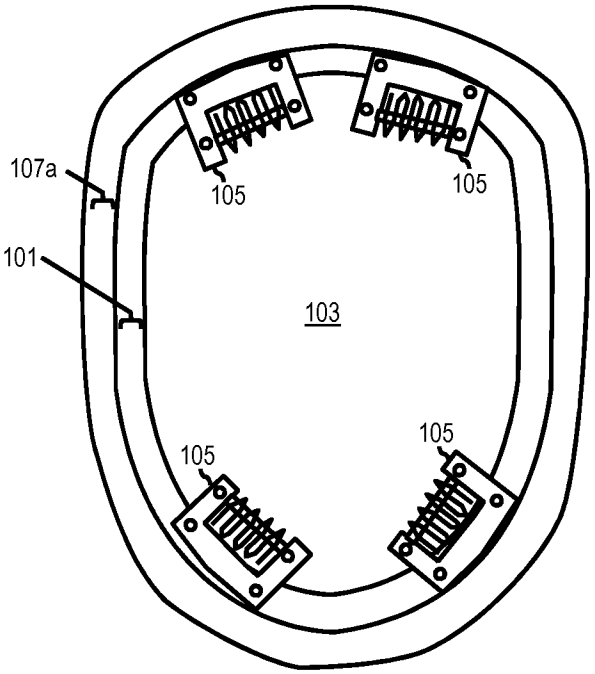

Adverting to FIGS. 1A and 1B, hair piece 100 includes an encasement layer 101, a tri-level virtual scalp 103, and comb clips 105. As shown, the encasement layer (e.g., binding) 101 is ⅛ inch (3.175 millimeters) and is a lightly coated silk ribbon (e.g., frame). The encasement layer 101 is stitched to surround and encase edges of the tri-level virtual scalp 103 as further described with respect to FIG. 2. The encasement layer 101 may have a range of 1/32 of an inch (0.79 millimeters) to ½ of an inch (12.7 millimeters). The encasement layer 101 may be formed of at least one of fine silk, nylon, polyester, TENCEL, milkweed seed-pod fibers, silk-cotton tree filaments, rayon, and ahimsa silk and have a thickness of 3 mommes to 15 mommes.

Additionally, as shown, comb clips 105 are medium nude color comb clips positioned with two comb clips 105 on a front portion and two comb clips 105 on a back portion of hair piece 100. The comb clips 105 may be sewn in to the hair piece 100, for instance, along a stitching to attach the encasement layer 101 and used to attach the hair piece to, for example, natural hair of a user's head. The comb clips 105 may be formed of metal, plastic, and the like, and may be painted, for instance, to match a color of the tri-level scalp 103. It is noted that comb clips 105 may be changed and arranged to suit suite different needs. For instance, fewer (e.g., 1, 2, 3) or more (e.g., 5, 6, 7, etc.) comb clips 105 may be used. Additionally, or alternatively, comb clips 105 may be positioned at different positions (e.g., along the outer perimeter, in different positions outside the outer perimeter, etc.) and at different orientations (e.g., with comb teeth facing in various directions).

Further, an extension 107 may be added depending on a design specification. For instance, FIG. 1A illustrates a full perimeter Swiss lace extension 107*a* and FIG. 1B illustrates a frontal perimeter Swiss lace extension 107*b*. The extensions 107*a* and/or 107*b* may extend from the encasement layer 101 a distance of, for instance, ⅛ of an inch (3.175 millimeters) to ¼ of an inch (6.35 millimeters).

Figure 2:
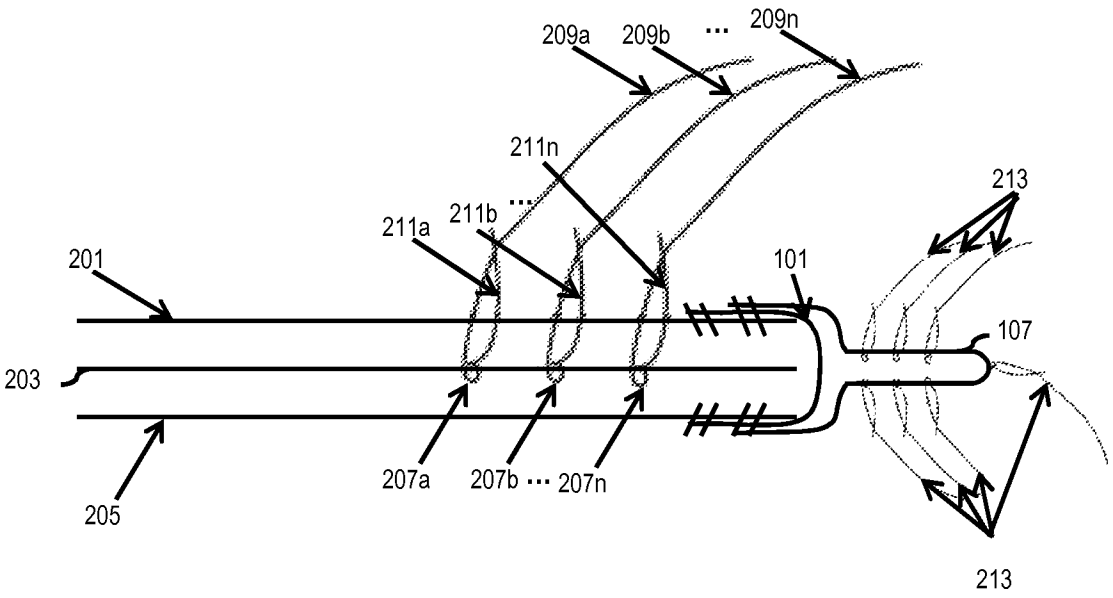
FIG. 2 illustrates a side view of a hair piece, in accordance with an exemplary embodiment.

Adverting to FIG. 2, the hair piece 100 includes a top layer 201, a center layer 203, and an under layer 205. As shown, each of the hair strands 207 is double knotted to center layer 203 and has a long portion 209 and return end 211 over vented through the top layer 201. Additionally, each of the hair strands 207 may be knotted separately from the other hair strands 207 (e.g., single hair—double knot).

The top layer 201 may be formed, for instance, of fine pure organic silk having a nude and/or scalp color. As such, the top layer 201 may be selected to resemble a realistic scalp color of a user, to hide a user's own hair color (which may be particularly important when worn on the head), and to have no reflective qualities adding to a user's natural appearance (e.g., not shiny or artificial in appearance). The top layer 201 may be formed of other suitable silk-like materials, such as, for example, nylon, polyester, TENCEL, milkweed seed-pod fibers, silk-cotton tree filaments, rayon, and ahimsa silk.

Furthermore, the material of the top layer 201 may facilitate a flow of moisture away through evaporation and exude harmful elements with perspiration. For instance, fine pure organic silk may be selected as silk may retain up to 30% of its own weight in moisture without feeling wet. A weave of the top layer 201 may be tight enough to secure hair in a position. Hair strands 207 may be vented up one hair at a time through the top layer 201, for instance, mimicking natural hair from a scalp. The top layer 201 may be configured allow easy styling and/or a unidirectional placement of hair strands 207 as well as to protect center layer 203 by providing a top enclosure. Further the top layer 201 may minimize excessive wear and loss of hair by protecting center layer 203 from exposure. It is noted that silk or a silk-like material may be used in top layer 201 to keep a form of a design that is flexible and does not shrink when wet (e.g., pre-shrunk).

The center layer 203 may be formed, for example, of fine nude color Swiss lace, super fine Swiss lace, French lace, and the like. Additionally, the center layer 203 may be selected to be lightweight, flexible, thin, fine, sturdy, open, breathable, and the like. Furthermore, the center layer 203 may be configured to have an open weave to enable a unidirectional ventilation to mimic natural hair and to allow a custom hair part. Single hair strands 207 may be double knotted onto center layer 203 to provide a realistic appearance and high durability (e.g., durable ventilation). The center layer 203 may comprise of 30 to 90 holes per square inch or about 55 holes per square inch to allow simplified control of density of hair for a natural appearance. Additionally, the center layer 203 may allow for easy reventing of hair strands 207 and to add hair for a refurbishing of the hairpiece 100. The center layer 203 may be configured to use lace that does not shrink when wet (e.g., preshrunk) that has a nude color to resemble a natural scalp and that is comfortable, particularly when worn for long periods on the head. In some embodiments, the center layer 203 is folded along an outer perimeter.

The under layer 205 may be formed, for example, of fine pure organic silk having a nude and/or scalp color. The under layer 205 may be formed of other suitable silk-like materials, such as, for example, nylon, polyester, TENCEL, milkweed seed-pod fibers, silk-cotton tree filaments, rayon, and ahimsa silk. The under layer 205 may be selected of an organic material. Additionally, the under layer 205 may be used to create a soft barrier that does not put stress on a user's hair and/or scalp and does not feel abrasive. The under layer 205 may resemble natural scalp color and hide a natural hair color of a user, which is particularly important when sitting on top of a user's hair and/or scalp. The material of under layer 205 may be thin e.g., 3 mommes to 15 mommes or 3 mommes to 8 mommes to enable the under layer 205 to be lightweight and breathable. The under layer 205 may be formed of a high density material (e.g., silk) that affords extra soft, pliable fabric that is comfortable and cosmetically pleasing. Additionally, the under layer 205 may be eco-friendly (e.g., organic) and not dyed. Furthermore, use of silk in the under layer 205 facilitates a flow of moisture away through evaporation and exudes harmful elements with perspiration as silk may retain up to 30% of its own weight in moisture without feeling wet. It is noted that silk may be used in under layer 205 to keep a form of a design that is flexible and does not shrink when wet (e.g., pre-shrunk).

As shown, the extension 107 is folded. The extension 107 may be added after the encapsulating of the center layer 203 by the layers 201 and 205 and the forming of the encasement layer 101. Additionally, hair strands 213 may be vented on a top portion, side portion, under portion, or a combination thereof of the extension 107 and affixed to the extension 107 using a (double) knot holding a single hair strand. The venting of hair strands 213 may substantially cover the extension 107 to hide extension 107. In some embodiments, hair strands 213 are each affixed by hand to the extension 107. Moreover, knots of hair strands 213 may be bleached (not shown) and further cosmetically enhanced, for instance, using a chiaroscuro coloring method described below. The extension 107 may be formed, for example, of fine nude color Swiss lace, super fine Swiss lace, French lace, and the like. The extension 107 may comprise of 30 to 90 holes per square inch or about 55 holes per square inch to allow simplified control of density of hair for a natural appearance. As shown, the extension 107 is stitched to layers 201-205 and encasement layer 101. It is noted that extension 107 may be attached to the layers 201-205 by using an adhesive. Additionally, extension 107 may extend on only a portion of the perimeter of the layers 201-205, for instance, in a front portion as shown in FIG. 1A.

The hair strands 207 and/or 213 may (e.g., long end 209 and/or return end 211) may be further enhanced, for example, using a chiaroscuro color method. Chiaroscuro, for example, refers to a method to create form, volume, and 3-dimensional effect using strong contrasting between light and dark (and also warm and cool colors). Such a method may be used to replicate a user's own growing hair to make hair enhancement (e.g., use of a hair piece) undetectable and seamless. Further, such a method in which each enhancer is colored using a systematic approach may be performed at various times, for instance, during a manufacturing of a hair piece at a factory, during a fitting at a studio, etc.

In one embodiment, a Chiaroscuro color method includes a range of three to five colors selected for color theme palette that represent user's natural color, such as, for example, a base (e.g., midtone), a highlight (e.g., lights reflected), and lowlights/root color (e.g., shadowing). By way of example, if a user has natural hair having a level 5 warm, a level 4 warm color is selected for roots of hair strands 207 and lowlight, a level 5 is selected for midrange of hair strands 207, and a level 7+ is selected for highlights of hair strands 207. In some embodiments, a "root/shadow" color is the darkest color. For example, if "root" color is chosen, the length of root/shadow color of hair strands 207 may be selected to extend from the root base (enters the silk top) a distance to appear as a gradual transition appearing natural, thereby avoiding an apparent abrupt change. For example, the length of root/shadow color of hair strands 207 may extend from the root base to about ⅝ of an inch or approximately ½ inch to ¾ inch (12.7 millimeters to 19.05 millimeters) in an organic seamless means.

For custom colorations, the "root" color may be hand painted on an entire root area (where the hair comes out of the virtual scalp) of hair strands 207 using a color brush and fanning technique to create a seamless graduation of the root color into other colors. For the underside towards the back and sometime sides of a hair piece 100, a root color of hair strands 207 may be used and taken longer to resemble a natural gradation from light in the front/top to darker under the crown to the nape and temporal area (e.g., side of head behind the ears). In some embodiments, a root color of hair strands 207 progressively gets longer going toward the back crown and nape as to transition into darker areas on a user. This enables a seamless transition into user's hair.

Additional highlights may be hand painted on hair strands 207 to break up any delineation of a root color applied and to increase a percentage in a face framing and top surface layer to mimic a sunkisted look. It is noted that there are exceptions for those who are bold with color. Additionally, some embodiments follow a user's own hair as guide to color hair strands 207.

Further, human gray variations (e.g., 100") may not have roots applied to hair strands 207. Additionally, ends of hair strands 207 may be oxidized using a mild bleaching balayage or flamboyage (French lacing) method. As such, color results end in a hair enhancement that is natural and is "grounded" in a user's natural hair and coloration to seamlessly transition into a user's natural hair. It is noted that the various examples using hair strands 207 may be applicable to hair strands 213.

Figure 3:
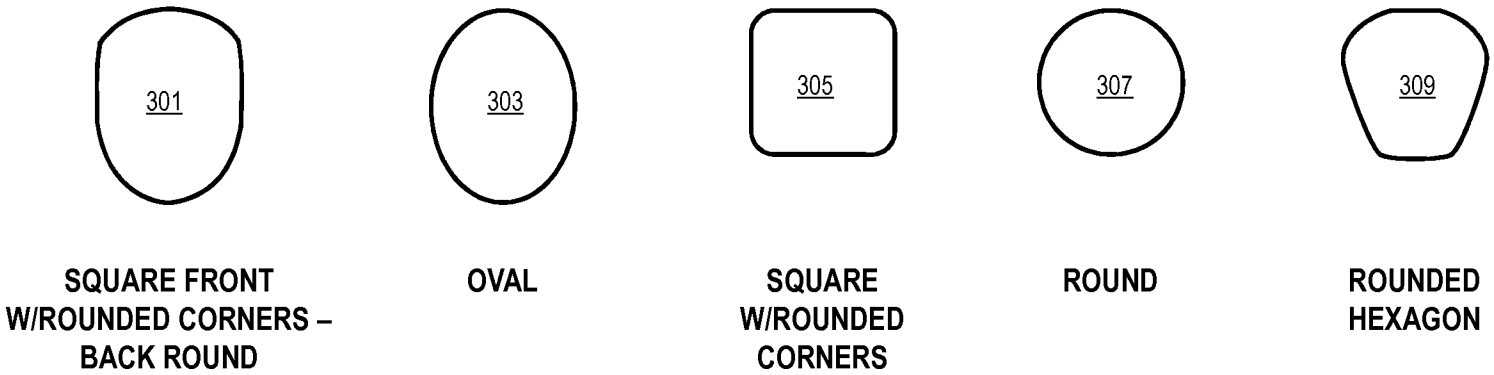
FIG. 3 illustrates a top view of various shapes of hair pieces, according to various exemplary embodiments.

Adverting to FIG. 3, an aerial view of base shapes of hairpieces (e.g., 100) is illustrated. As shown, hair piece 301 has a square front with rounded corners and a round back, hair piece 303 has a oval shape, hair piece 305 is a square (or rectangular) shape with rounded corners, hair piece 307 is a round (or oval shape) and hair piece 309 is a rounded hexagon. It is contemplated that shapes of hair pieces 301-309 may be substituted for the shape of hairpiece 100.

The hair piece 301 may have a soft "C" front with rounded corners back. Additionally, the hair piece 301 may have a shape that provides exceptional coverage of temple recession, bangs, crown, soft shapes transition to surrounding hair. Further the hair piece 301 may be worn in front of or set just behind a front hairline and may also provide mid to crown coverage.

The hair piece 303 may provide center coverage for general thinning in a center portion and/or parting depending on hair loss area and/or volume desired. The hair piece 303 may be selected, for example, to address a minor hair loss and/or improve volume. Additionally, the hair piece 303 may be selected, for instance, for users with rounded features and oval shape head.

The hair piece 305 may provide center coverage for thinning in a center portion and/or parting depending on hair loss area or volume desired. The hair piece 303 may be selected, for example, to address a mid to back/crown recession or crown separation. Additionally, the hair piece 305 may be used for spot coverage and/or for moderate loss or volume.

The hair piece 307 may provide crown and/or spot coverage, to improve volume, for spot coverage in case of scarring, alopecia, radiation, trichotillomania, for specific localized area of loss, and the like.

The hair piece 309 may, for instance, provide frontal coverage for deep frontal recession, bangs, temporary or permanent loss from facelifts, hair transplantation, and provide integration and smooth transition into own part/hair.

Figure 4:
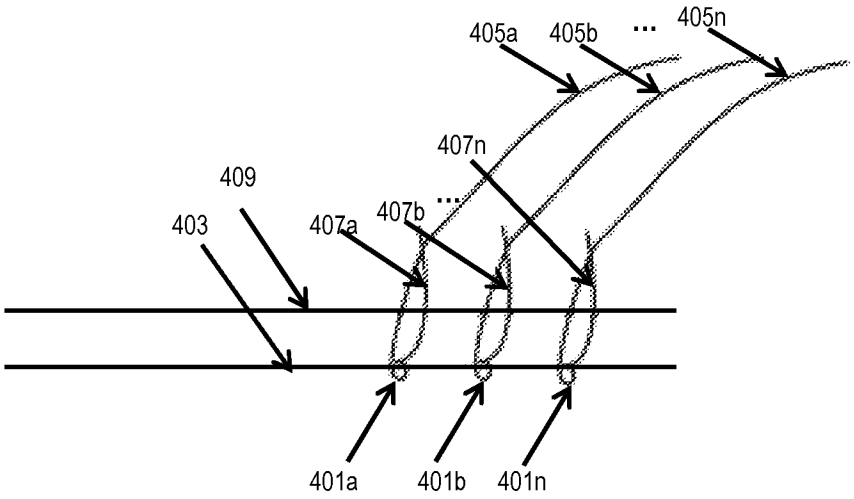
FIGS. 4 through 7 illustrate a method for manufacturing a hair piece, in accordance with an exemplary embodiment.

FIGS. 4 through 7 illustrate a method for manufacturing a hair piece, in accordance with an exemplary embodiment. As shown in FIG. 4, hair strands 401 are attached (e.g., single hair—double knot) to center layer 403 and each long 405 and return end 407 of each of the hair strands 401 is vented up (e.g., one hair at a time) through a top layer 409.

Figure 5:
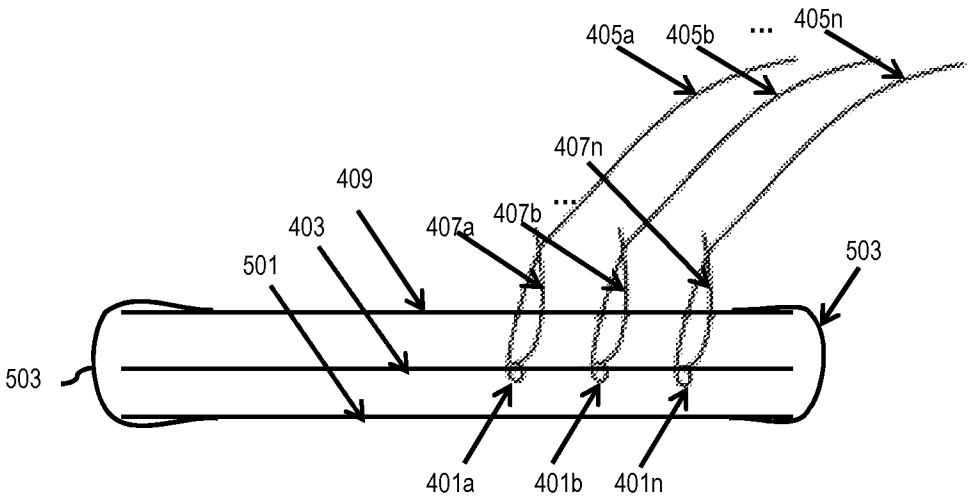

As shown in FIG. 5, an under layer 501 is positioned under the center layer 403 and an encasement layer 503 is placed over a top surface of the top layer 409 and over a bottom surface of the under layer 501. As illustrate, center, top, and under layers 403, 409, 501, respectively, are stacked having outer edges aligned.

Figure 6:
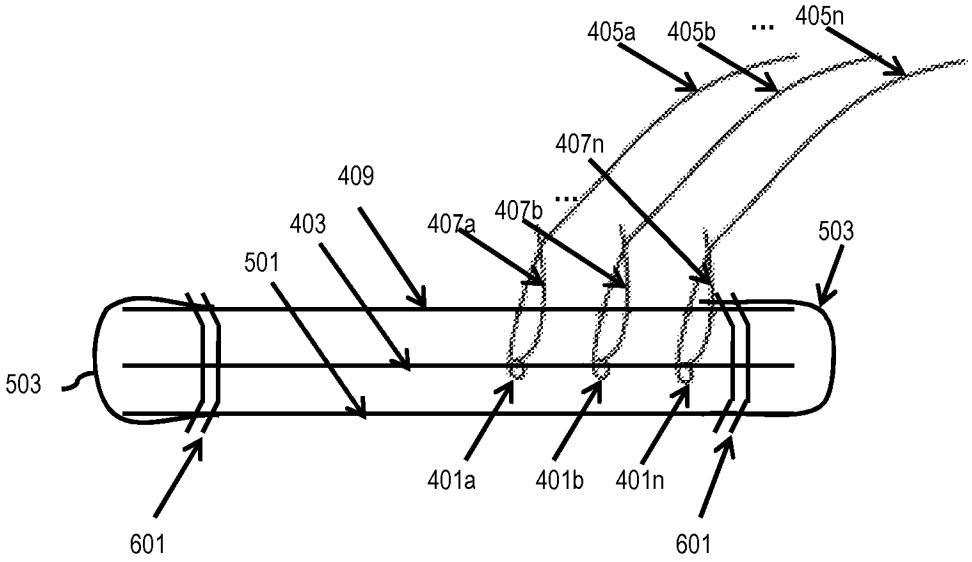

As shown in FIG. 6, stitches 601 are stitched through the encasement layer 503 and through the center, top, and under layers 403, 409, 501, respectively, to hold and protect the center layer 403 and to protect knots of hair strands 401. As shown, the stitches 601 are placed ⅛ inch (3.175 millimeters) from outer edges of the center, top, and under layers 403, 409, 501, respectively, resulting in an overlap of the encasement layer 503 over a top surface of the top layer 409 and over a bottom surface of the under layer 501. It is contemplated that the stitches 601 may be placed in a range of 1/32 of an inch (0.79 millimeters) to ½ of an inch (12.7 millimeters) from outer edges of the center, top, and under layers 403, 409, 501, respectively.

Figure 7:
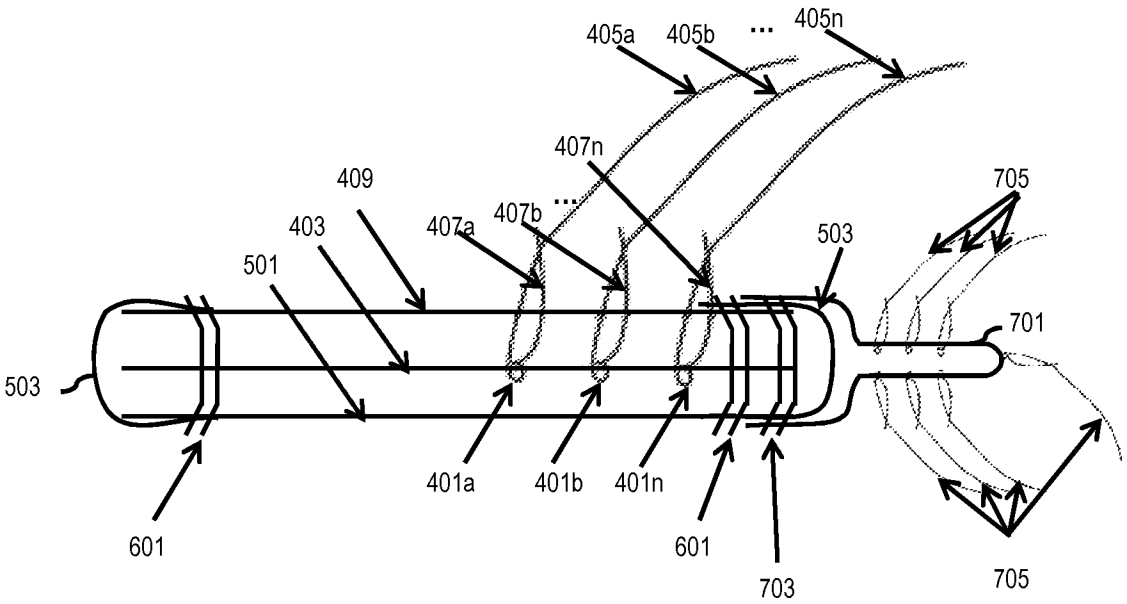

In FIG. 7, an extension lace 701 is placed on the encasement layer 503 and an outer edge of the center, top, and under layers 403, 409, 501, respectively. As shown, the extension lace 701 is placed over a portion (e.g., front half as shown in FIG. 1B) of the encasement layer 503. It is noted that the extension lace 701 may be omitted, placed over an entirety of the encasement layer 503, and placed over other portions of the encasement layer 503, such as, for instance, front and side portions, etc. Stitches 703 are stitched through the encasement layer 503 and through the center, top, and under layers 403, 409, 501 to hold the extension lace 701. As shown, the stitches 703 are placed 1/16 inch (1.58 millimeters) from outer edges of the center, top, and under layers 403, 409, 501. As shown, hair strands 705 are (double) knotted and over, under, and side vented (e.g., one hair at a time) to the extension lace 701. The knots may be bleached (not shown) and further enhanced, for instance, using the chiaroscuro coloring method described above. Additionally, comb clips (e.g., 105) may be added (not shown).

The embodiments of the present disclosure can achieve several technical effects, such as, for example, a hair piece having characteristics of seamless, light, breathable, durable, and realistic. The present disclosure enjoys industrial applicability in any of various types of uses to attach (human, artificial, animal, etc.) hair, particularly when used as a hair piece (e.g., wig, toupee, etc.).

In the preceding description, the present disclosure is described with reference to specifically exemplary embodiments thereof. It will, however, be evident that various modifications and changes may be made thereto without departing from the broader spirit and scope of the present disclosure, as set forth in the claims. The specification and drawings are, accordingly, to be regarded as illustrative and not as restrictive. It is understood that the present disclosure is capable of using various other combinations and embodiments and is capable of any changes or modifications within the scope of the inventive concept as expressed herein.

What is claimed is:

1. A hair product comprising:

a first layer;

a second layer having a lace structure;

a third layer, the first and third layers encasing the second layer; and a plurality of strands of hair, each of the plurality of strands of hair being affixed to the second layer and extending therefrom, wherein the first layer is formed of at least one of fine silk, nylon, polyester, TENCEL, milkweed seed-pod fibers, silk-cotton tree filaments, rayon, and ahimsa silk and has a thickness of 3 mommes to 15 mommes.

2. The hair product according to claim 1, wherein the second layer is formed of at least one of Swiss lace, super fine Swiss lace, and French lace and comprises 30 to 90 holes per square inch.

3. The hair product according to claim 2, wherein the third layer is formed of at least one of fine silk, nylon, polyester, TENCEL, milkweed seed-pod fibers, silk-cotton tree filaments, rayon, and ahimsa silk and has a thickness of 3 mommes to 15 mommes.

4. The hair product according to claim 1, wherein each of the plurality of strands of hair is affixed to the second layer by a knot or a double knot.

5. The hair product according to claim 1, wherein the plurality of strands of hair has a midtone and/or base color;

one or more of the plurality of strands of hair has a highlight and/or light color; and a portion of at least one of the plurality of strands of hair has a lowlight and/or dark color, the portion extending on the at least one of the plurality of strands of hair from the first layer to about ⅝ of an inch.

6. A hair piece comprising:

a base comprising first, second, and third layers, the first and third layers at least partially encasing the second layer;

a plurality of strands of hair extending from the second layer; and an encasement layer at least partially surrounding an outer perimeter of the base, the encasement layer being stitched to the base.

7. The hair piece according to claim 6, wherein each of the plurality of strands of hair includes one or both ends protruding through the first layer.

8. The hair piece according to claim 6, further comprising:

the encasement layer extending over one or both sides of the base 1/32 of an inch to ½ of an inch.

9. The hair piece according to claim 8, further comprising:

the encasement layer being formed of at least one of fine silk, nylon, polyester, TENCEL, milkweed seed-pod fibers, silk-cotton tree filaments, rayon, and ahimsa silk and having a thickness of 3 mommes to 15 mommes.

10. The hair piece according to claim 6, further comprising:

an extension piece affixed to an outer parameter of the base and/or the encasement layer; and a second plurality of strands of hair extending from the extension piece.

11. The hair piece according to claim 10, wherein the extension piece is formed of at least one of Swiss lace, super fine Swiss lace, French lace and comprises 30 to 90 holes per square inch.

12. The hair piece according to claim 10, wherein the second plurality of strands of hair has a midtone and/or base color;

one or more of the second plurality of strands of hair has a highlight and/or light color; and a portion of at least one of the second plurality of strands of hair has a lowlight and/or dark color, the portion extending on the at least one of the second plurality of strands of hair from the extension piece to about ⅝ of an inch.

13. The hair piece according to claim 10, wherein each of the second plurality of strands of hair is affixed to the extension piece by a knot or a double knot and each respective knot or double knot is bleached.

14. The hair piece according to claim 13, wherein one or more of the second plurality of strands of hair is vented on a top portion, side portion, under portion, or a combination thereof of the extension piece.

15. A hair product comprising:

a first layer having a thickness of 3 mommes to 15 mommes and being formed of at least one of fine silk, nylon, polyester, TENCEL, milkweed seed-pod fibers, silk-cotton tree filaments, rayon, and ahimsa silk;

a second layer having 30 to 90 holes per square inch and being formed of at least one of Swiss lace, super fine Swiss lace, French lace, the second layer having a folded perimeter;

a third layer having a thickness of 3 mommes to 15 mommes and being formed of at least one of fine silk, nylon, polyester, TENCEL, milkweed seed-pod fibers, silk-cotton tree filaments, rayon, and ahimsa silk, the first and third layers, at least partially, encasing the second layer;

an encasement layer surrounding edges of the first and third layers and extending about 1/32 of an inch to about ½ of an inch over outer surfaces of the first and third layers, the encasement layer being formed of at least one of fine silk, nylon, polyester, TENCEL, milkweed seed-pod fibers, silk-cotton tree filaments, rayon, and ahimsa silk;

a plurality of strands of hair, each of the plurality of strands of hair being affixed by a knot to the second layer and having long and return ends protruded though the first layer; and a plurality of medium nude color comb clips, each of the plurality of medium nude color comb clips being affixed to the third layer.

16. The hair product according to claim 15, wherein the first, second, and third layers have one of the following shapes:

a square front portion having rounded corners and a round back portion;

an oval;

a rectangular front portion having rounded corners and a rectangular back portion having rounded corners;

a circle; and a rectangular front portion having rounded corners and a hexagon back portion having rounded corners.

17. The hair product according to claim 15, further comprising:

the first layer being of fine nude color silk;

the second layer being of fine nude color open weave Swiss lace;

the third layer being of fine nude color silk;

the encasement layer being of fine nude color silk; and the plurality of strands of hair being affixed by a double knot.

18. The hair product according to claim 15, further comprising:

an extension piece adjacent to the encasement layer, the extension piece having 30 to 90 holes per square inch and being formed of at least one of the following Swiss lace, super fine Swiss lace, French lace; and a second plurality of strands of hair affixed to the extension piece by a knot or double knot, wherein each respective knot or double knot is bleached and one or more of the second plurality of strands of hair is vented on a top portion, side portion, under portion, or a combination thereof of the extension piece.

* * * * *